United States Patent [19]

Riley

[11] Patent Number: 5,048,310

[45] Date of Patent: Sep. 17, 1991

[54] APPARATUS FOR CHANGEABLE EARRING PENDENTS

[76] Inventor: Yong N. Riley, 626 Fairview Dr., Plymouth, Wis. 53073

[21] Appl. No.: 560,352

[22] Filed: Jul. 30, 1990

[51] Int. Cl.[5] ..... A44C 7/00

[52] U.S. Cl. ..... 63/13; 24/615

[58] Field of Search ..... 63/12, 13, 1.1, 2, 29.1; 24/614, 615

[56] References Cited

U.S. PATENT DOCUMENTS

| | | | |
|---|---|---|---|
| 1,134,372 | 4/1915 | Cameron | 63/1.1 X |
| 3,071,938 | 1/1963 | Davidson | 63/13 |
| 3,418,826 | 12/1968 | Wieshuber | 63/29.1 X |
| 4,353,225 | 10/1982 | Rogers | 63/13 |
| 4,590,649 | 5/1986 | Neilson, Jr. | 24/615 |
| 4,700,552 | 10/1987 | Haley | 63/12 |
| 4,776,184 | 10/1988 | Hakim | 63/20 |
| 4,781,036 | 11/1988 | Erickson | 63/12 |
| 4,783,974 | 11/1988 | Hernandez | 63/2 |
| 4,793,155 | 12/1988 | Law | 63/29.1 X |

*Primary Examiner*—Kenneth J. Dorner
*Assistant Examiner*—J. Bonifanti
*Attorney, Agent, or Firm*—Robert T. Johnson

[57] ABSTRACT

Apparatus is disclosed for ear mounts for earrings to which decorative pendents may be attached or detached, thus low cost pendents may be attached to high cost gold pierced ear studs, or to snap spring or screw on ear hangers.

2 Claims, 2 Drawing Sheets

APPARATUS FOR CHANGEABLE EARRING PENDENTS

SUMMARY OF THE INVENTION

Up to the present time. a purchaser of ear rings could obtain complete ear rings which included the decorative pendent permanently attached to the ear mount, and to have a change of decoration the whole ear ring was removed and a new assembled ear ring mounted on the ear.

This present invention is to disclose apparatus for removable and replaceable decorative ear ring pendents without removal of the clamp on or the ear ring stud from the ear of the wearer.

BACKGROUND ART PATENTS

U.S. Pat. No. 3,418,826 to Wieshuber for, "Earring - Interchangeable parts".

U.S. Pat. No. 4,353,225 to Rogers for, "Jewelry for Animals".

U.S. Pat. No. 4,700,552 to Haley for "Convertible Earring Construction". Disclosure is made in this patent of a clamp on earring and an ear pierced earring fitting thereon.

U.S. Pat. No. 4,776,184 to Hakim for Composite Jewelry. Disclosure is made in this patent of a selection of radial arm piece joinable with a pin stud.

U.S. Pat. No. 4,781,036 to Erickson, for "Pierced Ear Earring with Changeable Elements". Disclosure is made in this patent of an ear post threaded at both ends, with a front threaded cap for changing the decoration.

U.S. Pat. No. 4,783,974 to Hernandez for "Re-Attachable Break Away Ear Ring Ornaments". Disclosure is made in this patent of an earring ornament readily detachable from a wear or ear post.

None of the above patent references disclose or claim this present invention of changeable earring pendent apparatus, attachable to an ear ring stud in pierced ears, or to a clamp on ear ring holder.

An object of this invention is to disclose apparatus for changeable earring pendents by means of an ear post holder and ear post for a pierced ear and a female threaded section in said ear post holder and a male threaded segment fitting in said female threaded section and a pendent spring ring attached to the pendent spring ring.

Another object of this invention is to disclose apparatus for changeable earring pendents by means of an earring post ball and a slot in the earring post ball and a female opening in the slot and a V spring attached to a pendent spring ring and a male segment on the V spring and the V spring to fit in the slot and the male segment on the V spring fitting into the female opening in the slot.

Another object of this invention is to disclose apparatus for changeable earring pendents the apparatus comprising a screw-on ear ring mount and adjustable screw assembly and a U shape connector for joining back and front of the ear connector and an earring ball on the front of the ear connector and a slot in the earring ball and a female opening in the slot and a V spring insert and a male stud segment on the V spring inserted in the slot and the male stud segment fitting into the female opening in the slot and a pendent spring ring suspended from the leg of the V spring.

Another object of this invention is to disclose apparatus for changeable earring pendents wherein a snap on earring mount comprising a hinge for a snap spring and a snap spring ear connector and a slotted earring holder ball and a U shape connector for the holder ball and the snap spring ear connector.

Another object of this invention is to disclose apparatus for changeable earring pendents wherein a hanger hook fitting in a pierced ear and an intermediate pendent connector joining one end of the hanger hook and a pendent spring ring attached to the intermediate pendent connector.

Another object of this invention is to disclose apparatus for changeable earring pendents wherein a flat face surface disc as an ear post holder and a female threaded section in the bottom edge of the flat face surface disc.

DETAILED DESCRIPTION OF DRAWINGS

Figure 1:
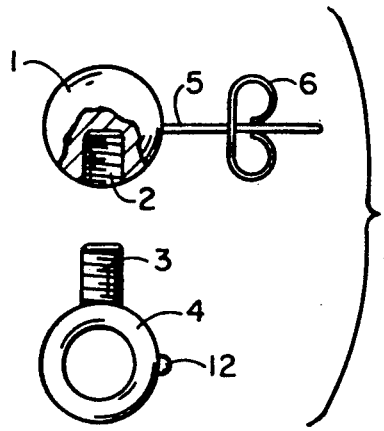
FIG. 1—Expanded side elevation view of earring post assembly.
Figure 2:
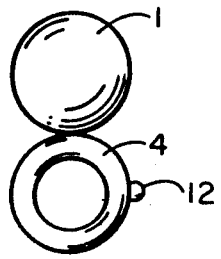
FIG. 2—Elevation front view of earring pendent attached by threading into ear ring post ball.

FIG. 1—Expanded side elevation view of earring post assembly wherein:

1—Female threaded ear post holder ball
2—Female threaded section in post ball (phantom view)
3—Male threaded segment
4—Pendent spring ring
5—Earring post
6—Rear anchor on ear ring post
12—Spring ring nub FIG. 2—Elevation front view of earring pendent attached by threading into ear ring post ball.

1—Female threaded ear post holder
4—Pendent spring ring
12—Spring ring nub

Figure 3:
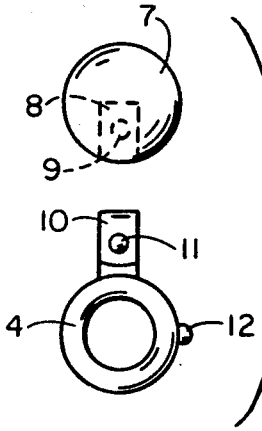
FIG. 3—Expanded elevation view of ear ring post assembly.
Figure 4:
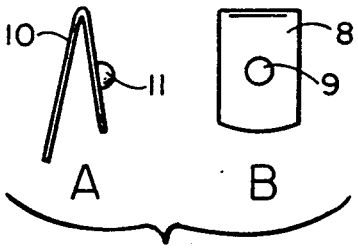
FIG. 4—Enlarged isolated edge elevation view of V spring and front view of ear post ball slot, A and B, respectively.

FIG. 3—Expanded elevation view of ear ring post assembly wherein:

4—Pendent spring ring
7—Slotted ear ring post ball
8—Slot in ear ring post ball
9—Female opening in slot
10—"V" spring to insert in slot
11—Male segment on V spring
12—Spring ring nub FIG. 4—Enlarged isolated edge elevation view of V spring and front view of ear post ball slot, A and B, respectively.

8—Slot of ear ring post ball (isolated view) B

Figure 5:
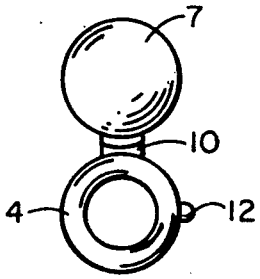
FIG. 5—Elevation front view of assembled ear ring pendent attached by snap fitting.
Figure 6:
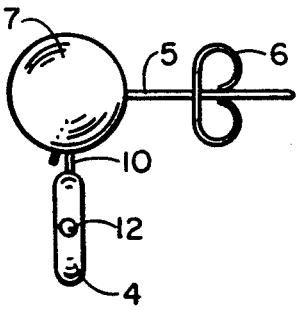
FIG. 6—Side elevation view of pendent attached to ear ring post ball.
Figure 7:
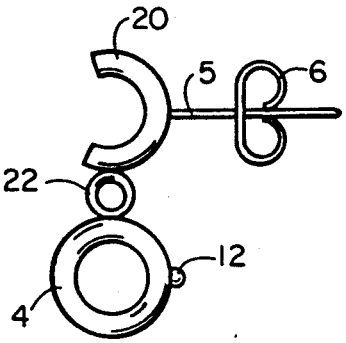
FIG. 7—Elevation view of ear ring alternate assembly.
Figure 9:
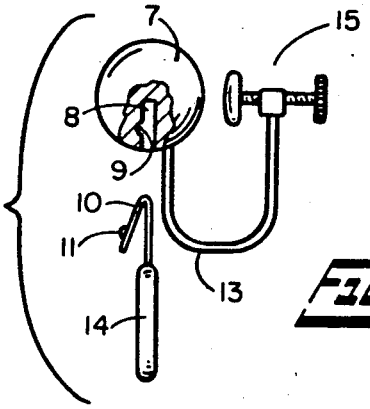
FIG. 9—Elevation side view of screw on ear ring.
Figure 10:
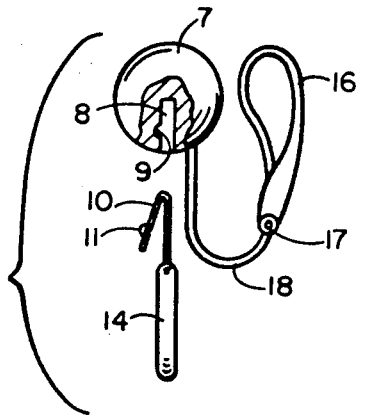
FIG. 10—Elevation side view of snap on ear ring.
Figure 11:
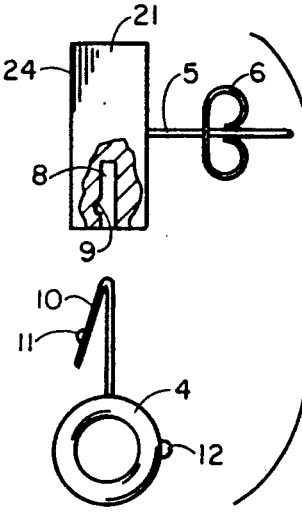
FIG. 11—Side elevation view of pierced ear post bar.
Figure 12:
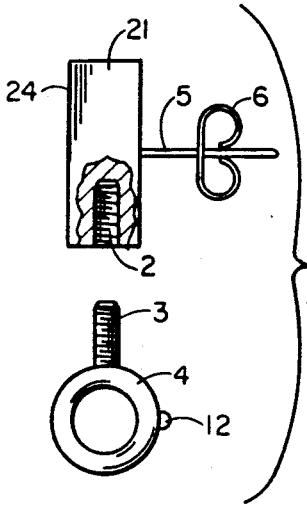
FIG. 12—Side elevation expanded view of pierced ear post bar with threaded pendent spring ring.
Figure 8:
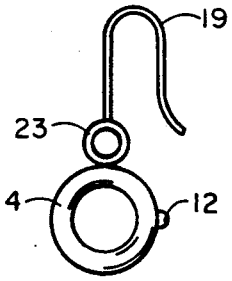
FIG. 8—Elevation view of ear ring pendent and hanger.

9—Female dot opening in post ball slot—B
10—V spring to insert in slot (edge view) A
11—Male stud segment on V spring insert—A FIG. 5—Elevation front view of assembled ear ring pendent attached by snap fitting.
4—Pendent spring ring
7—Slotted ear ring post ball
10—"V" spring to insert in slot
12—Spring ring nub FIG. 6—Side elevation view of FIG. 5 pendent attached to ear ring post ball.
4—Pendent spring ring (edge view)
5—Ear ring post
6—Rear anchor on earring post
7—Slotted ear ring post ball
10—V spring inserted in slot
12—Spring ring nub FIG. 7—Elevation view of ear ring alternate assembly.
4—Pendent spring ring
5—Ear ring post
6—Rear anchor on ear ring post
20—Ear ring post bead
22—Ear ring pendent connector FIG. 8—Elevation view of ear ring pendent and hanger.
4—Pendent spring ring
12—Spring ring nub
19—Hanger hook
23—Intermediate pendent connector FIG. 9—Elevation side view of screw on ear ring.
7—Slotted ear ring ball
8—Slot of ear ring ball
9—Female opening in slot
10—V spring (edge view)
11—Male stud segment on V spring insert
13—U shape connector for back and front of ear connector
15—Adjustable screw assembly
14—Ear ring pendent FIG. 10—Elevation side view of snap on ear ring.
7—Slotted ear ring post holder ball
8—Slot in ear ring ball
9—Female opening in slot
10—V spring (edge view)
11—Male stud segment on V spring insert
14—Ear ring pendent
17—Hinge for snap spring
18—U shape connector for front ear ring ball and snap spring ear connector FIG. 11—Side elevation view of pierced ear post bar wherein:
4—Pendent spring ring
5—Ear ring post
6—Rear anchor threaded on post
8—Slot of ear ring front stop
9—Female opening in slot
10—V spring
11—Male stud segment on V spring
12—Spring ring nub
21—Slotted ear post holder segment
24—Flat face surface disc FIG. 12—Side elevation expanded view of pierced ear post bar with threaded pendent spring ring.
2—Female threaded ear post holder (phantom view)
3—Male threaded segment
4—Pendent spring ring
5—Ear ring post
6—Rear anchor on ear ring post
12—Spring ring nub
21—Slotted ear post holder segment
24—Flat face surface disc This invention for apparatus for changeable earring pendents discloses provision for changeable pendents on earring mounts such as earring posts for pierced ears or clamp on attachment to the ears, and changeable pendents can be attached or detached from the posts or clamp on attachment.

By providing apparatus for attaching or detaching various pendents on earrings there is a savings, since only the pendents are changed rather than the whole earring and pendent, thus the posts or clamps could be of a precious metal such as a gold alloy, while the pendent may be of a base metal or other decoration of low cost, rather than a whole earring and pendent of a gold alloy.

There is alternate apparatus to carry out the above described invention, which alternates are shown in the FIGS. 1 through 12, and are described as follows.

The apparatus of this invention can be described as an ear ring post 5 extending through a pierced ear, and rear anchor on ear ring post 6 threaded and screwed onto the ring post 5. Ear post ball 1, is attached to ear ring post 5 on the end opposite the rear anchor on ear ring post 6. A female threaded opening 2 is provided in ear post holder ball 1, and on being mounted on the ear, the female threaded opening 2 is pointed downward for threading of a male threaded segment 3 into the female threaded opening 2, and attached to the opposite end of the male threaded segment 3 is a pendent spring ring 4. This spring ring is the conventional type with a spring ring nub 12 to be partly rotated to open a small slot for mounting of a decorative pendent therein. To change the decorative pendent this can be done by hanging on the pendent spring ring 4, and removed therefrom without removal of the ear ring post 5 from the pierced ear, and since the earring post 5 remains mounted in the ear the ear post ball 1, may serve as the ear decoration. The components of the above described invention are shown in FIG. 1 prior to assembly, while FIG. 2 is an elevation front view of assembled components of FIG. 1.

As an alternate to the disclosure shown in FIGS. 1 and 2, described above, FIGS. 3, 4, 5, and 6 show alternate apparatus for changeable earring pendents. FIG. 3 is an expanded front elevation view of earring post assembly showing slotted earring post ball 7 and V spring 10 attached to pendent spring ring 4, and male segment 11 on V spring insert. Slot 8 in ear ring post ball 7 is provided for insertion of V spring 10 and male segment 11 on V spring 10, fits in female opening 9 in slot 8 in ear ring post ball to thus hold the V spring 10 in slotted ear ring post ball 7, to hold the spring ring 4 in suspension for mounting of a decorative pendent. FIG. 5 is a front elevation view of the V spring 10 assembled in earring post ball 7, while FIG. 6 is an elevation side view of the assembly.

FIG. 7 is a side elevation view of an assembly of earring post bead 20 attached to ear ring post 5, and pendent spring ring 4 is attached to earring post bead 20 through earring pendent connector 22. Any desired decorative pendent can be attached to spring ring 4, by opening the spring ring by conventional rotation of spring ring nub 12.

A pendent such as that shown in FIG. 8 may be hung on spring ring 4 by means of hanger hook 19 suspended from spring ring 4 of FIGS. 2, 4 and 7, for example. The hanger hook 19 is in turn attached to intermediate pendent connector 23, from which pendent spring ring 4 is suspended.

FIGS. 9 and 10 show ear attachment by other than a pierced ear post. FIG. 9 shows apparatus of an adjustable screw assembly 15 connected to a slotted ear ring ball 7 by means of a U shape connector 13 for back and front of ear ring, and ear ring pendent 14 is suspended from slotted earring ball 7 by means of a V spring 10 fitting in female opening slot 8. The V spring 10 is held in the female opening slot 8 by means of male stud segment 11 on V spring 10, and the male stud segment 11 fitting in female opening 9 in slot of ear ring ball 8, with the spread of the V spring of sufficient pressure to hold the male stud segment 11 in female opening 9 in slot 8 of earring ball.

FIG. 10 discloses a snap spring ear connector 16, attached to hinge for snap spring 17, and the snap spring 17 attached to a U shape connector for front earring ball and snap spring ear connector 18. The other components are the same as FIG. 9.

There are other variations of the earring mounts, which instead of an earring ball, there may be a slotted ear post holder segment 21, with a flat face surface 22 for mounting of a precious stone such as a diamond, in addition to a pendent spring ring 4.

Further description of the invention is made as follows of apparatus for changeable earring pendents by means of an ear post holder ball (1) and ear ring post 5 for a pierced ear and a female threaded section 2 in said ear post holder and a male threaded segment 3 fitting in said female threaded section 2 and a pendent spring ring 4 attached to the male threaded segment (3) for attachment of a decorative pendent.

Further description is made of the apparatus for changeable earring pendents by means of an earring post ball (1) and a slot (8) in the earring post ball (1) and a female opening (9) in the slot 8 and a V spring (10) attached to a pendent spring ring (4) and a male segment (11) on the V spring (10) and the V spring 10 to fit in the slot (8) and the male segment (11) on the V spring (10) fitting into the female opening (9) in the slot (8).

As an alternate apparatus for changeable earring pendents the apparatus may comprise a screw-on ear ring mount and adjustable screw assembly (15) and a U shape connector (13) for joining back and front of the ear connector and an earring ball (7) on the front of the ear connector (13) and a slot (8) in the earring ball (7) and a female opening (9) in the slot 8 and a V spring insert (10) and a male stud segment (11) on the V spring (10) inserted in the slot (8) and the male stud segment (11) fitting into the female opening (9) in the slot (8) and a pendent spring ring (14) suspended from a leg of the V spring 10.

For non pierced ears the following apparatus for changeable earring pendents wherein a snap on earring mount comprises a hinge (17) for a snap spring and a snap spring ear connector (16) and a slotted earring holder ball (7) and a U shape connector (18) for the earring holder ball (7) and the snap spring ear connector (16).

As another alternate for pierced ears, apparatus for changeable pendents can be described as a hanger hook (19) fitting in a pierced ear and an intermediate pendent connector (23) joining one end of the hanger hook and a pendent spring ring (4) attached to the intermediate pendent connector (23).

The ear post holder as described above may be a ball or one of many other shapes such as a flat face surface disc (24) as an ear post (5) holder and a female threaded section (2) in the bottom edge of the flat face surface disc (24).

Having described my invention, I claim:

1. Apparatus for changeable earring pendents wherein the improvement comprises:

(a) a screw on ear ring mount comprising an adjustable screw assembly,
(b) a U-shaped connector for joining back and front of an ear connector,
(c) an earring ball on the front of said ear connector,
(d) a slot in said earring ball,
(e) a female opening in said slot,
(f) a V spring insert,
(g) a male stud segment on said V spring insert,
(h) said V spring inserted in said slot,
(i) said male stud segment fitting into said female opening in said slot and
(j) a pendent spring ring suspended from a leg of said V spring.

2. Apparatus for changeable earring pendents wherein the improvement comprises;

(a) a snap on earring mount comprising,
(b) a hinge for snap spring,
(c) a snap spring ear connector,
(d) a U-shaped connector for joining back and front of ear connector,
(e) an earring ball on the front of said ear connector,
(f) a slot in said earring ball,
(g) a female opening in said slot
(h) and a V spring insert,
(i) a male stud segment on said V spring insert,
(j) said V spring inserted in said slot,
(k) said male stud segment fitting into said female opening in said slot and
(l) a pendent spring ring suspended from a leg of said V spring.

* * * * *